US005199129A

United States Patent [19]

Salecker et al.

[11] Patent Number: 5,199,129

[45] Date of Patent: Apr. 6, 1993

[54] TORQUE MONITORING SYSTEM FOR ROTARY DRAIN AND SEWER CLEANING APPARATUS

[75] Inventors: Roy Salecker; Rockwell T. Sloter, both of Mendota, Ill.

[73] Assignee: Spartan Tool, A Div. of Heico, Inc., Mendota, Ill.

[21] Appl. No.: 856,524

[22] Filed: Mar. 24, 1992

[51] Int. Cl.[5] ..... B08B 9/02

[52] U.S. Cl. ..... 15/104.33; 226/25

[58] Field of Search ..... 15/104.33; 226/11, 25; 408/16

[56] References Cited

U.S. PATENT DOCUMENTS 3,496,681 2/1970 Oswald ..... 15/49.1

3,742,548 7/1973 Ciaccio ..... 15/104.33

5,031,276 7/1991 Babb et al. ..... 15/104.33

*Primary Examiner*—Edward L. Roberts

*Attorney, Agent, or Firm*—Wood, Phillips, Van Santen, Hoffman & Ertel

[57] ABSTRACT

A rotary drain and sewer cleaning apparatus includes a flexible elongate cable insertable into a line. An end of the elongate cable is attached in a drum and a portion of the elongate cable is wound in the drum. A motor rotates the drum. A power supply and switch selectively provide current to the motor causing the motor to rotate. A circuit includes a sensor for measuring a motor drive torque as the drum rotates and generating a torque signal representing motor drive torque level. An indicator is controlled by the torque signal and indicates the torque level.

11 Claims, 2 Drawing Sheets

TORQUE MONITORING SYSTEM FOR ROTARY DRAIN AND SEWER CLEANING APPARATUS

FIELD OF THE INVENTION

This invention relates generally to rotary drain and sewer cleaners and, more particularly, to a rotary drain and sewer cleaner including a torque monitoring circuit having an indicator.

BACKGROUND OF THE INVENTION

Rotary drain and sewer cleaners have been utilized to clear obstructed sewer or drain lines clogged, for example, by sewage waste, by penetrating tree roots, etc. Such cleaning apparatus includes a frame with a drum rotatably mounted thereon. One end of a flexible elongate cable or snake is attached inside the drum and a portion thereof is wound inside the drum and exits the drum through a feeder. A cutter is attachable to an opposite end of the elongate cable. Typically, a motor with a belt/pulley drive rotates the drum. As the motor rotates the drum, an operator inserts the elongate cable into the drain or sewer line. Usually the obstructions are cleared by a combination of an inward movement of the elongate cable caused by the operator and the rotation of the cutter caused by the motor.

However, a dangerous condition occurs if the cutter becomes engaged with the obstruction and the obstruction restricts further rotation of the elongate cable by the motor. The strain caused by further rotation of the motor can damage the cutter or break the elongate cable. Such a condition could harm the operator if the elongate cable breaks adjacent an opening to the drain or sewer line. When the cable breaks, the torque on the motor instantaneously goes from very high to very low causing the broken end of the cable to whip.

Prior art rotary drain and sewer cleaners limit torque applied to the elongate cable and cutter by employing a slip-type clutch between the motor and the drum. Since torque limitations for both cutters and elongate cables are known, the prior art rotary drain and sewer cleaners utilize a slip-type clutch which slips just below these torque limitations. However, these slip-type clutches wear, are unreliable, and fail to provide an audible or visible indication of a high torque condition. These prior art cleaners may provide excess torque if improperly adjusted or insufficient torque due to wear.

SUMMARY OF THE INVENTION

A rotary drain and sewer cleaning apparatus includes a flexible elongate cable insertable into a line. An end of the elongate cable is attached in a drum and a portion of the elongate cable is wound in the drum. A motor rotates the drum. A power supply connected to a switch selectively provides current to the motor causing the motor to rotate. A circuit includes a sensor for measuring a motor drive torque as the drum rotates and generates a torque signal representing motor drive torque level. An indicator controlled by the torque signal indicates the motor drive torque level.

Another feature of the invention is an indicating means which illuminates a first indicator when the motor drive torque level is below an allowable torque and illuminates a second indicator when the motor drive torque level is above the allowable torque.

In still another feature of the invention, the sensor includes a current sensing relay having a first coil associated with normally open and normally closed contacts, and a sensing coil.

Other objects and features of the invention will be readily apparent.

DETAILED DESCRIPTION OF THE INVENTION

Figure 1:
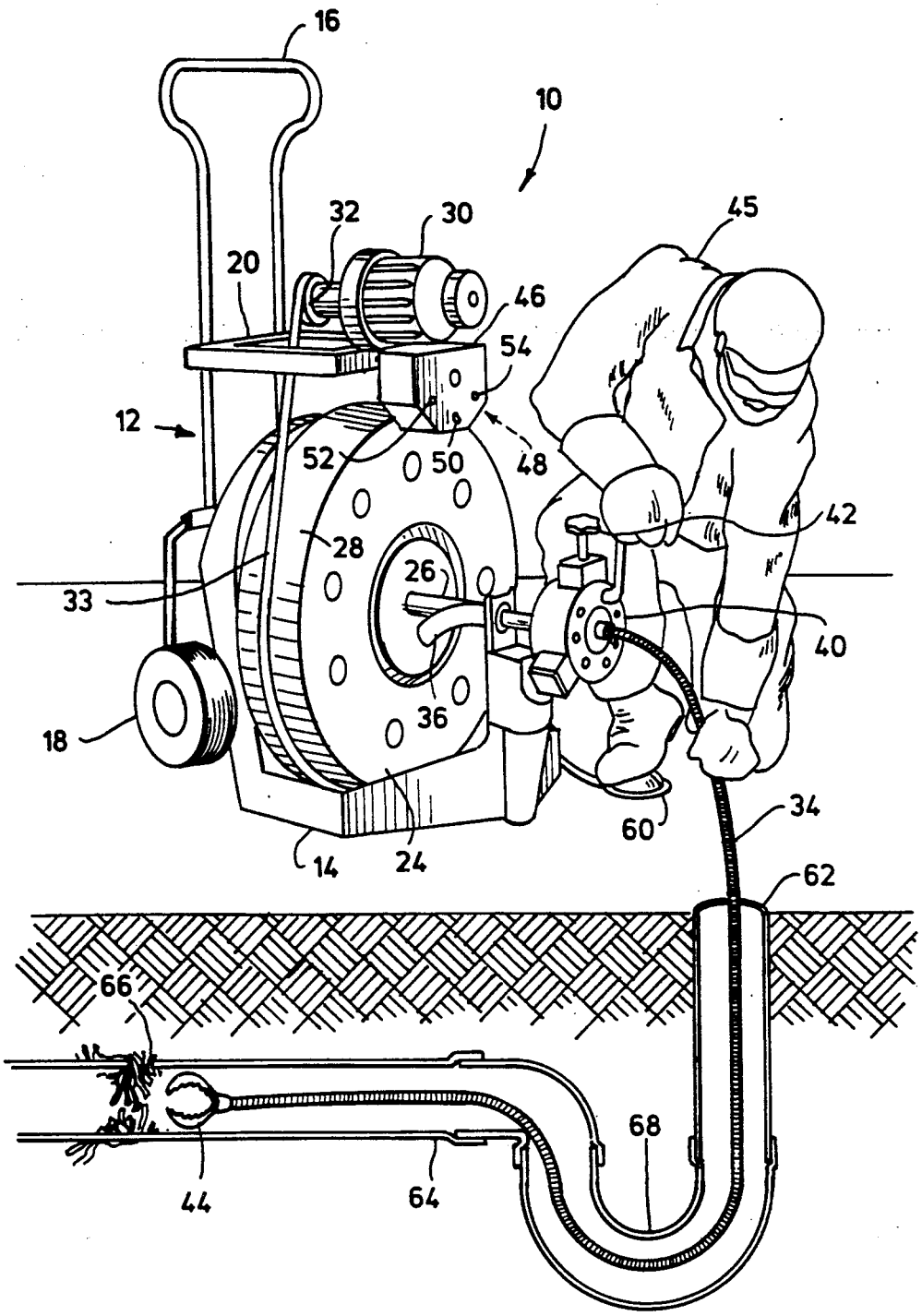
FIG. 1 is a perspective view of a drain and sewer cleaner according to the present invention in use in a drain line shown in section.

FIG. 1 is a view of rotary drain and sewer cleaning apparatus 10 including a portable frame 12 having a base 14, and a vertical support 16 extending from the base 14, and a wheel 18. A motor mount 20 is attached to the frame 12 and extends transverse to the vertical support 16. A drum 24 mounted on the frame 12 is rotatable with respect to the frame 12 about an axis 26 fixed to the vertical support 16. The rotatable drum 24 includes a cylindrical outer surface 28.

A drive motor 30 is attached to the cleaning apparatus 10 by the motor mount 20 and includes a pulley 32. A belt 33 engages the cylindrical outer surface 28 and the pulley 32 to rotate the drum 24 in a clockwise or counter-clockwise direction with respect to the frame 12. Alternatively, a direct motor drive/drum assembly could be used.

A flexible elongate cable or snake 34 is wound inside the rotatable drum 24 and extends through a feed tube 36 which rotates with and projects transverse to the rotatable drum 24. The feed tube 36 guides the elongate cable 34 from the drum 24 to a power feeder 40 which includes a control knob 42. Preferably, a cutter 44 is attached to an end of the elongate cable 34.

The control knob 42, when loosened, allows an operator 45 to remove the elongate cable 34 from the drum 24 or to feed the elongate cable 34 into the drum 24 without using the drive motor 30. When the control knob 42 is tightened and the motor 30 is rotating the drum 24, the operator 45 can feed cable 34 into or out of the drum 24 while the cable 34 rotates using the power feeder 40 or allow the drum 24 to rotate without feeding cable 34.

Figure 2:
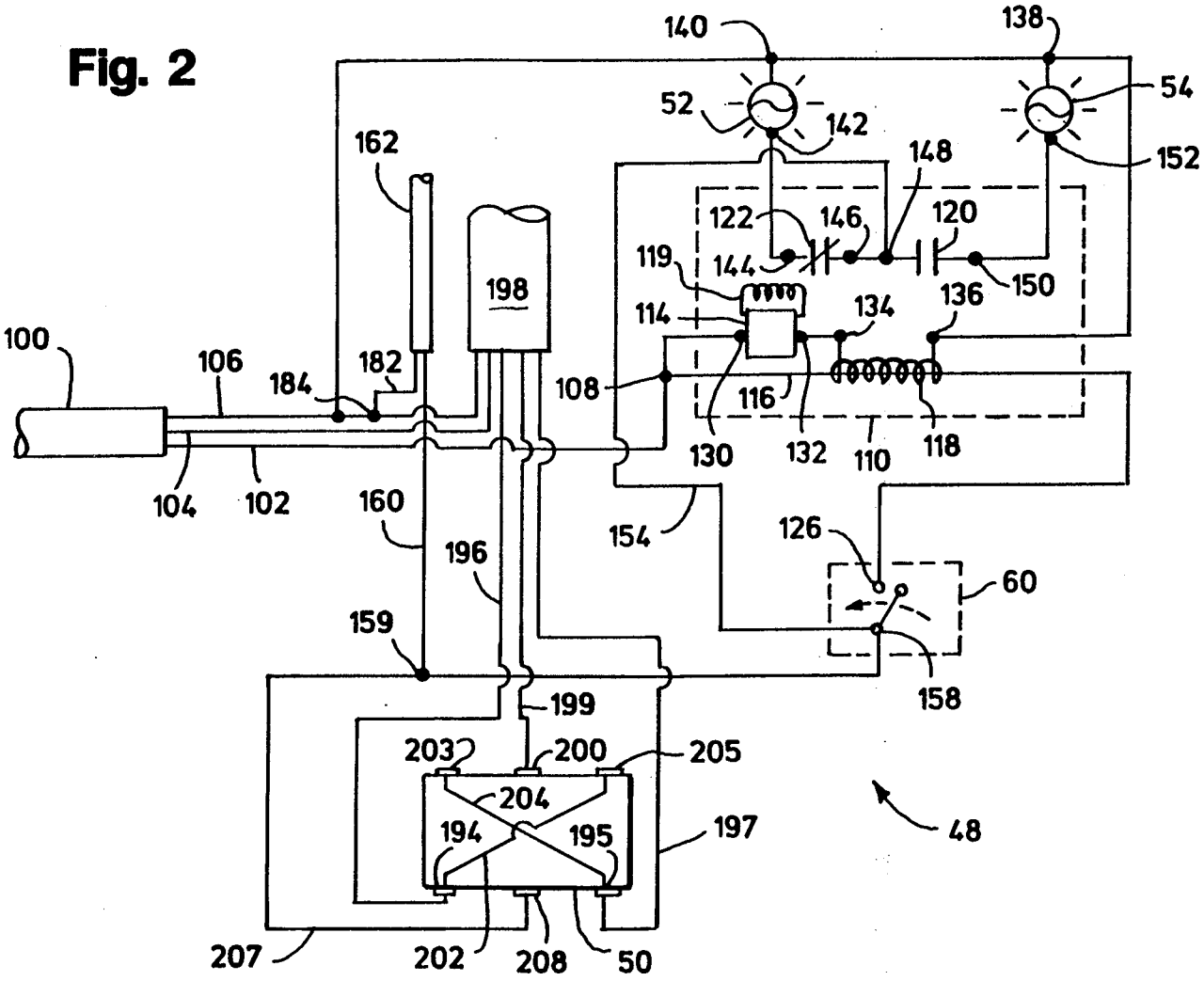
FIG. 2 is a schematic of a torque monitoring circuit.

A housing 46 encloses a torque monitoring circuit 48, described further in conjunction with FIG. 2. Mounted on the housing 46 is an on/off directional control switch 50, a first indicating light 52 and a second indicating light 54. The torque monitoring circuit 48 is connected to a power supply (not shown). The switch 50 has three positions: ON 1 (enable clockwise rotation), ON 2 (enable counter-clockwise rotation), and OFF. Once the switch 50 is moved to either ON 1 or ON 2, the torque monitoring circuit 48 is powered and the drum 24 rotates if the operator 45 depresses a foot switch 60.

In use, the operator 45 turns the switch 50 to either ON 1 or ON 2, depresses the foot switch 60, and inserts the elongate cable 34 through a drain or sewer opening 62 into a drain or sewage line 64 having an obstruction 66 located therein. As the drum 24 rotates, the operator feeds the elongate cable 34 further into the drain or sewer line 64. Due to the flexibility of the elongate cable 34, the cable 34 navigates around bends 68 in the drain or sewer line 64.

As described above, if the cutter 44 becomes engaged with the obstruction 66, the cable 34 can break and cause harm to the operator 45 or the cutter 44 can be damaged. The magnitude of current fed to the motor 30 is directly proportional to the torque output of the motor 30. Since torque limitations for both cutter and elongate cables are known, an allowable torque level (which corresponds to an allowable current level), acceptably below the torque limitations of the cutter 44 and elongate cable 34, can be selected. The present invention solves these problems by monitoring current to the motor and by providing the operator 45 an indication of excess torque.

FIG. 2 shows a schematic diagram for the torque monitoring circuit 48. A line input 100 from a power source includes a current source conductor 102, a ground conductor 104, and a neutral conductor 106. The current source conductor 102 is connected to a terminal 108. The terminal 108 is connected to a current sensing relay 110.

The current sensing relay 110 includes a sensing circuit 114, a current feed line 116, a current transformer sensing coil 118, and a relay coil 119 associated with a normally open contact 120 and a normally closed contact 122. The sensing circuit 114 controls the contacts 120, 122 by sensing a magnetic field induced in the sensing coil 118 due to current flowing through the current feed line 116. When the sensing circuit 114 measures a current on the sensing coil 118 which corresponds to a torque level above the selected allowable torque level, the sensing circuit 114 energizes the coil 119 to break the normally closed contact 122 and close the normally open contact 120.

The current feed line 116 is connected to the terminal 108 and extends continuously through the current sensing relay 110 to a terminal 126 of the foot switch 60. A terminal 130 of the sensing circuit 114 is connected to the terminal 108. A terminal 132 of the sensing circuit 114 is connected to a terminal 134 of the coil 118. A terminal 136 of the coil 118, a terminal 138 of the second light 54 and a terminal 140 of the first light 52 are electrically connected to the neutral conductor 106.

A terminal 142 of the first light 52 is connected to a terminal 144 of the normally closed contact 122. A terminal 146 of the normally closed contact 122 is connected to a terminal 148 of the normally open contact 120. A terminal 150 of the normally open contact 120 is connected to a terminal 152 of the second light 54. The terminal 146 of the normally closed contact 122 and the terminal 148 of the normally open contact 120 are connected by a conductor 154 to a terminal 158 of the foot switch 60.

The terminal 158 of the foot switch 60 is connected to a terminal 159 which is connected to a conductor 160 from a brake cord connector 162. A second conductor 182 from the brake cord connector 162 is connected at a terminal 184 to the neutral conductor 106. The switch 50 can be a double pole, double throw center off switch Model No. 82608 manufactured by Arrow Hart. Terminals 194 and 195 of the switch 50 are connected to the motor 30 through conductors 196 and 197, respectively, associated with the motor cord connector 198. A neutral conductor 199 from the motor cord connector 198 is connected to a terminal 200. A first jumper 202 connects a terminal 205 with the terminal 194. A second jumper 204 connects a terminal 203 with the terminal 195.

A current conductor 207 connects line current controlled by the switch 60 to a terminal 208. When the switch 50 is in the ON 1 position, the switch 50 connects the terminal 208 with the terminal 195 and the terminal 205 with the terminal 200. As result, the conductor 196 is connected to the neutral conductor 199 through the first jumper 202 and the conductor 197 is connected to the current conductor 207.

When the switch 50 is in the ON 2 position, the switch 50 connects the terminal 208 to the terminal 194 and the terminal 200 to the terminal 203. As a result, the conductor 196 is connected to the current conductor 207 and the conductor 197 is connected to the neutral conductor 199 through the second jumper 204.

Referring now to FIG. 1, before the cutter 44 reaches the obstruction 66, a very low current draw is required by the motor 30 and the torque monitoring circuit 48 illuminates the first indicating light 50, for example a green light, to indicate to the operator 45 that the torque output of the motor 30 is below the allowable torque.

As the cutter 44 engages the obstruction 66, current draw by the motor 30 increases due to the load on the cutter 44 and cable 34. If the current draw by the motor 30 increases such that the measured torque level exceeds the allowable torque, then the torque monitoring circuit 48 turns off the first indicating light 52 and illuminates the second indicating light 54, for example a red light. The operator 45, noticing the motor has reached the allowable torque, can either release the foot switch 60 or stop or slow inward movement of the cable 34 to prevent over-torquing the cable 34 or damaging the cutter 44. If the operator 45 stops inward movement or partially withdraws the cable 34, the current draw by the motor 30 will decrease and the torque monitoring circuit 48 will extinguish the second indicating light 54 and illuminate the first indicating light 52.

If the operator 45 releases the foot switch 60 to relieve over-torquing, the operator 45 can withdraw the elongate cable 44 to release the cutter 44 from the obstruction 66. When the operator 45 depresses the foot switch thereafter, the torque monitoring circuit 48 will illuminate the first indication light due to the lower current draw of the released cutter 44.

The current sensing relay 110 may be an adjustable electronic current sensing relay such as Model W236ACX-3 sold by Magnecraft in Northbrook, Ill. Alternatively, a ECS Series Universal AC Current Sensor sold by SSAC, Inc. in Baldwinsville, N.Y. could be used. By rotating a trip point adjustment screw to vary a current trip point between a minimum and maximum trip current (for example 2–20 Amps for the SSAC current sensing relay), the allowable torque level can be selected.

Other means are contemplated in addition to the first and second lights 52, 54 to indicate over-torquing. For example, a speaker could generate a distinct tone to represent over-torquing. A level meter could also be used.

The above description is meant to be illustrative and not restrictive. Modifications will be readily apparent.

We claim:

1. In a rotary drain and sewer cleaning apparatus including a flexible elongate cable insertable into a line, a drum having an end of the elongate cable attached therein and a portion of the elongate cable wound therein, a motor drive means for rotating said drum, and a means for selectively providing power to the drive means causing the drive means to rotate, the improvement comprising:

a circuit including sensing means for measuring a motor drive torque as said drum rotates and generating a torque signal representing motor drive torque level, and means controlled by said torque signal for indicating said torque level.

2. The rotary drain and sewer cleaning apparatus of claim 1 wherein said indicating means includes a first indicator and a second indicator, said indicating means illuminating said first indicator when said motor drive torque level is below an allowable torque and illuminating said second indicator when said motor drive torque level is above said allowable torque.

3. The rotary drain and sewer cleaning apparatus of claim 2 wherein the sensing means includes a current sensing relay having a relay coil associated with normally open and normally closed contacts, and a current sensing coil.

4. The rotary drain and sewer cleaning apparatus of claim 3 wherein said sensing coil comprises a current transformer sensing motor drive current.

5. The rotary drum and sewer cleaning apparatus of claim 4 wherein said sensing means energizes said relay coil when said sensing means measures a current corresponding to the allowable torque on said sensing coil.

6. The rotary drain and sewer cleaning apparatus of claim 4 wherein said sensing means is powered by said current feed line.

7. The rotary drain and sewer cleaning apparatus of claim 2 wherein said sensing means includes a means for adjusting said allowable torque.

8. A rotary drain cleaning apparatus including:

a flexible elongate cable insertable into a line;

a drum having an opposite end of the elongate cable attached thereto and a portion of the elongate cable wound therein;

a motor drive means for rotating said drum;

a means for selectively providing current to the drive means causing the drive means to rotate;

a circuit including a sensing means for measuring motor drive current as said drum rotates and generating a current signal representing the motor drive current, and means controlled by said current signal for indicating said motor drive current.

9. The rotary drain cleaning apparatus of claim 8 wherein said indicating means includes a first indicator and a second indicator, said sensing means illuminating said first indicator when said drive means is rotating and said motor drive current is below an allowable current and illuminating said second indicator when said drive means is rotating and said motor drive current is above said allowable current.

10. The rotary drain cleaning apparatus of claim 9 wherein the sensing means includes a current sensing relay having a relay coil associated with normally open and normally closed contacts, and a current sensing coil.

11. A rotary drain cleaning apparatus including:

a flexible elongate cable insertable into a line;

a drum having an opposite end of the elongate cable attached thereto and a portion of the elongate cable wound therein;

a motor drive means for rotating said drum;

a means for selectively providing current to the drive means causing the drive means to rotate;

a circuit including a sensing means for measuring motor drive current as said drum rotates and generating a current signal representing the motor drive current, and means controlled by said current signal for indicating said motor drive current, said indicating means including an indicator and illuminating said indicator when said drive means is rotating and said motor drive current is above a selected allowable current.

* * * * *